United States Patent [19]

Higashinakagawa et al.

[11] Patent Number: 4,528,246

[45] Date of Patent: Jul. 9, 1985

[54] SHADOW MASK

[75] Inventors: Emiko Higashinakagawa, Kawasaki; Kanemitsu Sato, Yokohama; Michihiko Inaba, Kawasaki; Yasuhisa Ohtake, Fukaya; Masaharu Kantou, Taishicho; Masayuki Itoh, Kawasaki, all of Japan

[73] Assignee: Tokyo Shibaura Denki Kabushiki Kaisha, Kawasaki, Japan

[21] Appl. No.: 526,824

[22] Filed: Aug. 26, 1983

[30] Foreign Application Priority Data

Aug. 27, 1982 [JP] Japan ..... 57-147740
Feb. 8, 1983 [JP] Japan ..... 58-19085

[51] Int. Cl.[3] ..... H01J 29/07; C21D 9/46

[52] U.S. Cl. ..... 428/596; 148/12.1; 148/11.5 R; 313/402

[58] Field of Search ..... 313/402; 445/47; 428/596, 606; 156/644; 428/611; 148/12.1

[56] References Cited

U.S. PATENT DOCUMENTS

| | | | |
|---|---|---|---|
| 3,772,103 | 11/1973 | Holowka et al. | 313/402 |
| 3,909,928 | 10/1975 | Sato et al. | 156/644 |
| 3,929,532 | 12/1975 | Kuzminski | 156/644 |
| 3,936,691 | 2/1976 | Bakker et al. | 313/404 |
| 3,974,416 | 8/1976 | Van der boot et al. | 313/417 |
| 4,210,843 | 7/1980 | Avadani | 313/402 |
| 4,259,611 | 3/1981 | Van Raalfe | 313/402 |
| 4,271,571 | 6/1981 | Tsuda et al. | 29/25.18 |
| 4,306,172 | 12/1981 | Matsukura et al. | 313/402 |
| 4,309,886 | 1/1982 | Kubota et al. | 72/202 |
| 4,325,752 | 4/1982 | Suda et al. | 148/12.1 |
| 4,420,366 | 12/1983 | Oku et al. | 156/644 |
| 4,427,460 | 1/1984 | Araki et al. | 148/12.1 |
| 4,472,236 | 9/1984 | Tanaka et al. | 156/644 |
| 4,482,426 | 11/1984 | Maynard et al. | 156/644 |

FOREIGN PATENT DOCUMENTS

| | | | |
|---|---|---|---|
| 2438029 | 2/1975 | Fed. Rep. of Germany | 313/402 |

OTHER PUBLICATIONS

Metals Handbook, 9th Edition, vol. 3, 793.
Textures of Materials, (Gottstein and Luecke), vol. II (1978).
"Partial List of Trademarks", MPEP, p. A-3, Rev. 4, Oct. 1980.

*Primary Examiner*—L. Dewayne Rutledge
*Assistant Examiner*—John J. Zimmerman
*Attorney, Agent, or Firm*—Schwartz, Jeffery, Schwaab, Mack, Blumenthal & Evans

[57] ABSTRACT

Disclosed is a shadow mask comprising an alloy such as an inver type alloy and having {100} texture on a mask face. Also disclosed is a useful process for preparing the shadow mask.

10 Claims, 8 Drawing Figures

SHADOW MASK

BACKGROUND OF THE INVENTION

This invention relates to a structural member for color picture tube of a color television, more particularly to a shadow mask.

The shadow mask is one of the members of the color picture tube which are liable to be inversely affected by the thermal expansion thereof due to the temperature elevation caused by electron beams shot from electron guns of the color picture tube to collide with the members, and which are required to be prepared in a higher density and minuteness by a photoetching method.

Heretofore, there has been well known in the art the so called shadow mask tube, in which a shadow mask is employed, as a picture tube for color television.

As shown in FIG. 1, which is a perspective view of a shadow mask tube using a delta type electron gun, the shadow mask tube is constituted by providing a shadow mask 3 having a number of perforations 3*a*, 3*b*, . . . for passing electron beams between the three-electron guns 1*a* to 1*c* and the tri-color fluorescent face 2. The shadow mask 3 has the function of rearranging the electron beams shot from the three electron guns 1*a* to 1*c* against a specific perforation for passing electron beams, for example, 3*c*, as the target to have the correct beam spots projected on the respective colors' fluorescent portions 2*a* to 2*c* of the tri-color fluorescent face 2.

The above perforations 3*a*, 3*b*, . . . for passing electron beams are generally protected against generation of scattered electrons by working a face 4 confronting the fluorescent face 2 (hereinafter referred to as "mask face") into a shape engraved in a semi-spherical shape, as shown in an enlarged sectional view in FIG. 2.

The relative positions, sizes and shapes of the electron beam-passing perforations 3*a*, 3*b*, . . . in the shadow mask 3 are set in sufficiently high precision. In this connection, if the working precision of the above perforations 3*a*, 3*b*, . . . is poor, there may be caused image deterioration by blurring of colors, color irregularities or the like which is called as doming phenomenon.

On the other hand, in these days, there is an increasing general demand of "fineness of texture" for television pictures, and the transmitting system is being changed to what is called the high quality television system, for which the scanning line number is required to be increased to twice as much as that of the conventional system. Thus, to cope with such a demand, it is strongly desired to develop a picture tube capable of reproducing pictures which are clear and of fine texture. Also, along with such a desire, it has become necessary to form the electron beam-passing perforations in high density and minuteness.

However, according to the photoetching method of the prior art generally employed for production of shadow masks, it has been very difficult to form electron beam-passing perforations which are minute and high in precision. More specifically speaking, when minute and highly precise perforations for passing electron beams may be attempted to be formed by use of the technique of the prior art, the resultant perforations for passing electron beams have been those as shown in, for example, FIG. 3(*b*), wherein the perforations as viewed from the mask face 4 are ununiform in both of positions and shapes, thus being low in precision.

Also, apart from such a problem, as the electron beam-passing perforations are made higher in density and minute, the electron beams shot from electron guns are collided against the shadow mask at increased percentage, whereby the relative positional relation between the perforations and the fluorescent body is changed through the thermal expansion of the shadow mask due to the temperature elevation of the shadow mask to cause a new problem of occurence of color deviation phenomenon called "purity drift" (hereinafter referred to as "PD").

SUMMARY OF THE INVENTION

This invention has been accomplished to cope with the above problems. Accordingly, an object of this invention is to provide a shadow mask which is capable of surpressing the thermal expansion caused by electron beams colliding against the shadow mask, and therefore makes it possible to produce a color picture tube being free from the PD.

Another object of the invention is to provide a shadow mask which can form minute perforations for passing electron beams, at high precision and at high density.

The above objects of this invention can be achieved by providing a shadow mask characterized in that it comprises an alloy of a face-centered cubic lattice structure or a body-centered cubic lattice structure, and an f-parameter of the {100} texture on a mask face is at least 0.35.

The above shadow mask can be prepared by;

(1) a process which comprises a step (a) of hot rolling of a shadow mask material comprising an alloy of a face-centered cubic lattice structure or a body-centered cubic lattice structure to have the {100} texture on the rolled face, a step (b) of strong working by cold rolling of said shadow mask material to have the {110} texture on the rolled face, a step (c) of applying a heat treatment on the strongly worked rolled material at a temperature not lower than the recrystallization temperature of said alloy to obtain a shadow mask original plate having the {100} texture again on the rolled face, and a step (d) of applying etching on the {100} plane of said original plate to form perforations for passing electron beams; or (2) a process which comprises a step, alternative to the steps (b) and (c) of the above process (1), of obtaining the original plate by applying cold rolling at a reduction ratio not exceeding 50%/pass and optionally heat treatment to the shadow mask material obtained in the step (a).

BRIEF DESCRIPTION OF THE DRAWINGS

This invention will be described below in detail with reference to the accompanying drawings.

In the drawings

DETAILED DESCRIPTION OF PREFERRED EMBODIMENTS

This invention has been accomplished on the basis of a finding that the nonuniformity in shapes of the electron beam-passing perforations as described above is caused by irregularity in the crystal directions in the mask face of the original shadow mask of the prior art.

Figure 3A:
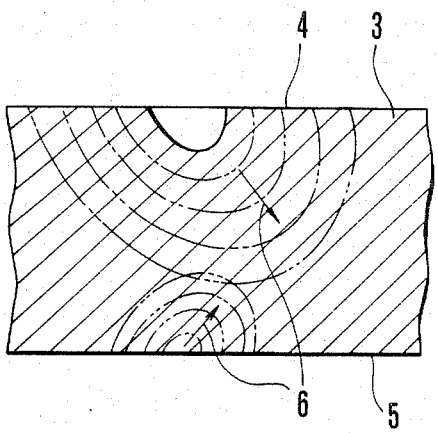
FIG. 3(*a*), FIG. 3(*b*) and FIG. 3(*c*) are illustrations for explanation of the shadow mask formed according to the process for producing a shadow mask original plate of the prior art, said FIG. 3(*a*) showing a sectional view indicating the etching situation at the cross-section of the shadow mask, FIG. 3(*b*) showing the front view of the shadow mask surface as viewed from the mask face, and FIG. 3(*c*) being a photograph (magnification: about 150) corresponding to FIG. 3(*b*)
Figure 3B:
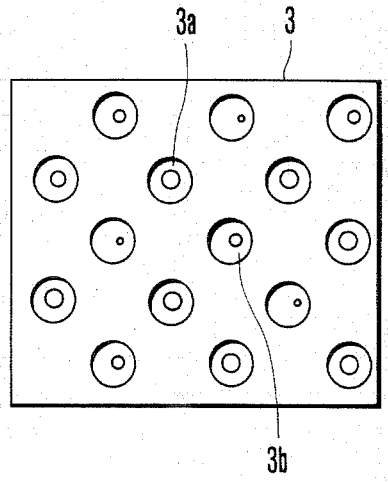
Figure 3C:
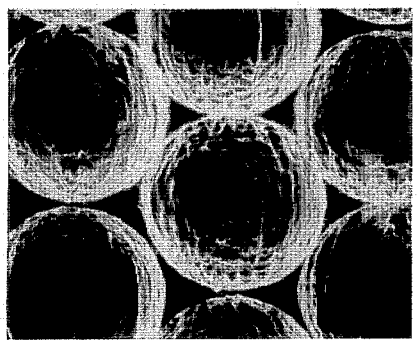

As shown in FIG. 3(*a*), when the directions of the crystal grains are irregular on the mask face 4 of the shadow mask original plate and the face 5 opposite thereto, and etching is applied on said original plate, there is created a difference in etching speed between the crystal grains which can be easily be etched and those which can be etched with difficulty. As a result, there may be caused scatterings such as deviation in the etching direction 6, whereby both the positions and shapes of the electron beam-passing perforations 3*a*, 3*b* are made ununiform.

The present inventors have found that by use of a shadow mask original plate wherein an f-parameter of {100} texture on its mask face is 0.35 or more (more preferably 0.40 to 1.0), its etching precision can be improved greatly.

The f-parameter of the {100} texture on the mask face herein mentioned is defined as follows. That is, it is defined by the following formula, which is an integrated ratio of all crystallinities of the components of the {100} crystallographic axis directions in the direction perpendicular to the mask face of individual grains of a polycrystal:

$$f = \int_0^{\frac{\pi}{2}} V\phi \cos\phi \, d\phi$$

wherein $V\phi$ is a volume ratio of a grain and $\phi$ is an angle of the direction perpendicular to the mask face from the <100> directions of respective crystal grains.

As the shadow mask material to be used in this invention, it is preferred to use an alloy having a face-centered cubic lattice structure or a body-centered cubic lattice structure in order to have the crystal faces regularly arranged. More preferably, an invar type alloy may be used because thermal problems can be overcome with a material having a thermal expansion coefficient of approximately zero. Typical examples are Invar alloy (36Ni-Fe), ultra-invariable steel (32Ni-5Co-63Fe), stainless invariable steel (54Co-9.3Cr-36.5Fe), 43Pd-57Fe alloy and the like.

The shadow mask according to this invention can be prepared by a process which comprises a step of hot rolling, for reduction of plate thickness, of a shadow mask material comprising an alloy of a face-centered cubic lattice structure or a body-centered cubic lattice structure to have the {100} texture on the rolled face; a step of strong working by cold rolling of said shadow mask material to have the {110} texture on the rolled face; a step of applying a heat treatment on the strongly worked rolled shadow mask material at a temperature not lower than the recrystallization temperature of said alloy to obtain a shadow mask original plate having again the {100} texture on the rolled face, and a step of applying etching on the {100} plane of said shadow mask original plate to form electron beam-passing perforations.

The above-mentioned strong working by cold rolling should preferably be carried out under the condition of a reduction ratio of 70% or more (up to 99.9%, preferably).

In the above process, the shadow mask material having again the {100} texture on the rolled face may be further subjected, if desired, to cold rolling under the condition of a reduction ratio of 25% or less which is the range under which the crystal faces are not rotated to obtain a shadow mask original plate, followed by etching working of the shadow mask original plate, whereby a shadow mask material which is more highly precise in the direction of its thickness can be obtained.

Besides the process as described above, the shadow mask according to this invention may otherwise be prepared by a process as described below:

Namely, it is a process which comprises a step of applying hot rolling on the shadow mask material comprising an alloy of a face-centered cubic lattice structure or a body-centered cubic lattice structure to have the {100} texture on the rolled face, a step of applying cold rolling at a reduction ratio not exceeding 50%/pass and, if necessary, heat treatment on the hot rolled material to provide a shadow mask original plate, and a step of applying etching on the {100} plane of said shadow mask original plate to form electron beam-passing perforations. Cold processing is performed at a reduction ratio not exceeding 50%/pass, for the purpose of preventing the crystal directions on the rolled face from being slipped from the {100} plane during application of strong working. The reduction ratio during the above cold rolling may preferably be 5% to 30% in practical applications.

The heat treatment may be applied after the above cold rolling at about 500° C., which is a temperature not higher than the recrystallization temperature of the alloy, for the purpose of stabilizing the {100} crystal face through stress relief annealing. In the step of obtaining a shadow mask original plate by applying desired cold rolling and heat treatment, for example, cold rolling at a reduction ratio of 50%/pass or less may be applied for plural times, followed finally by heat treatment, or alternatively the operation of applying each cold rolling followed by heat treatment may be repeated for plural times.

Thus, according to this invention, the electron beam-passing perforations are formed by etching a shadow mask original plate obtained by providing the {100} texture on the rolled face. Therefore there is created no difference in etching speed to enable formation of minute electron beam-passing perforations at high precision and at high density. For this reason, it is possible to produce a shadow mask of a shadow mask tube capable of giving a picture of high quality.

Also, on account of the use of an alloy of a face-centered cubic lattice structure or a body-centered cubic lattice structure with very small thermal expansion such as invar type alloys, etc., generation of the PD due to thermal expansion by the temperature elevation of a shadow mask can be prevented. Accordingly, it is rendered possible to obtain a shadow mask tube satisfying the requirements for a high quality television system by use of the shadow mask produced according to this invention. Besides, as an additional effect, the process of this invention can be practiced easily to an enormous practical advantage.

The present invention is now described in greater detail by the following Examples:

EXAMPLE 1

An invar alloy comprising the components of 36Ni-Fe was molten and its ingot was made into a wire of 6 mm in diameter according to the continuous hot wire forming step. This wire was forged in the longer direction to be made into a plate having a cross-section of 2 mm in thickness and 50 mm in width, which plate was used as the shadow mask material.

The shadow mask material was applied with rough rolling according to hot rolling at 900° C., which is a step for reducing thickness, to obtain a plate with a cross-section of a thickness of 1 mm and a width of 100 mm. The aforesaid 900° C. is a temperature higher than the recrystallization temperature of the above invar alloy, thus producing the {100} texture on the rolled face.

As the next step, the plate obtained according to this hot rolling was subjected to cold rolling once by strong working at a reduction ratio of 90% so as to be made into a plate with a thickness of 0.1 mm and a width of 1000 mm. According to this strong working, the crystal face were rotated, whereby the {110} texture was obtained on the rolled face.

Then, a heat treatment at 920° C. exceeding the recrystallization temperature was applied only once for one hour on this plate, whereby the crystallographic axes were rotated to obtain again the {100} texture on the rolled face. (The degree of gathering may desirably be 35%, more preferably 40% or more, as mentioned above.)

The state of the rolled surface after completion of each of the above respective steps were examined by X-ray diffraction to find that the f-parameter of the {100} texture was 0.40 at the stage of the hot rolling which was the primary thickness reducing step, the f-parameter of the {110} texture was 0.38 at the stage of the subsequent strong working by cold rolling, and further the f-parameter of the {100} texture was 0.42 after the heat treatment at 920° C. exceeding the recrystallization temperature.

Figure 4A:
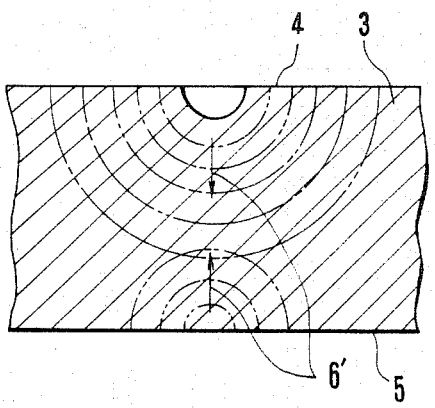
FIG. 4(*a*), FIG. 4(*b*) and FIG. 4(*c*) are ilustrations for explanation of the shadow mask formed by a process according to an example of this invention, said FIG. 4(*a*) showing a sectional view indicating the etching situation at the cross-section of the shadow mask, FIG. 4(*b*) showing the front view of the surface of the shadow mask as viewed from the mask face, and FIG. 4(*c*) being a photograph (magnification: about 200) corresponding to FIG. 4(*b*)
Figure 4B:
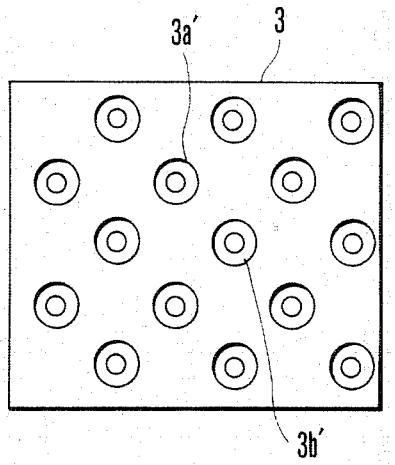
Figure 4C:
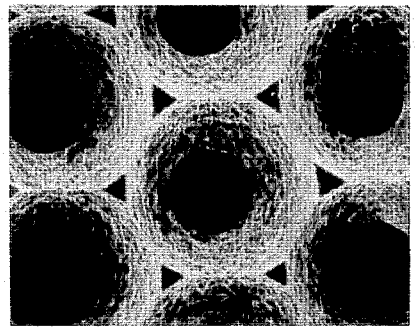

The shadow mask original plate thus obtained was applied on the mask face 4 and the opposite face 5 thereto as shown in FIG. 4(*a*) successively, with photoetching at a temperature of 65° C. by use of an etchant comprising an aqueous solution containing 43% of ferric chloride, 6% of ferrous chloride and 0.1% of hydrochloric acid to form perforations for passing electron beams. During this operation, the pitches between the electron beam-passing perforations were made about 0.3 mm to form about 520,000 electron beam-passing perforations as a shadow mask for 14-type television, as shown in FIG. 4(*b*) seen from the direction of the mask face 4 and also in FIG. 4(*c*), which is a photograph corresponding thereto. On the other hand, for the purpose of comparison, after the above cold rolling according to strong working, a stress relief thermal treatment was conducted at 500° C. Photoetching was applied on the resultant shadow mask having substantially no {100} texture on the mask face, whereby the shapes of the electron beam-passing perforations became the same as shown in FIG. 3(*b*) and also in FIG. 3(*b*) of a photograph corresponding thereto.

As seen from the above results, according to this invention, more minute electron beam-passing perforations can be formed at high precision and high density. This can be done owing to the etching progress direction which is substantially perpendicular to the mask face, as shown in FIG. 4(*a*).

EXAMPLE 2

In order to enhance the precision in the thickness direction of a shadow mask, there was employed a shadow mask original plate which was prepared by a process in which, after carrying out cold rolling by the strong working in the same manner as in Example 1, a heat treatment was applied at a recrystallization temperature or higher, followed by cold rolling at a reduction percentage not exceeding 25%. (This is because the rotation of {100} plane can be suppressed at a reduction ratio of 25% or lower.)

According to the process in this Example, it was possible to reduce the pitch width to about $\frac{1}{3}$ with increase of the electron beam-passing perforations to 5-fold, as compared with those of the shadow mask of the prior art. At the same time, it was also possible to prevent the doming phenomenon due to thermal expansion of the shadow mask, on account of the use of an Invar alloy having very small thermal expansion coefficient as the shadow mask material, thus giving a shadow mask suited for the purpose of a high quality television.

EXAMPLE 3

An invar alloy comprising the components of 36% Ni-Fe was molten and its ingot was made into an wire of 6 mm in diameter according to the continuous hot wire forming step. This wire was forged in the longer direction to be made into a plate of 1 mm in thickness and 100 mm in width. As the next step, it was hot rolled at 900° C. to a thickness of 0.5 mm, followed by cold rolling at a reduction ratio of 30% to obtain a thin plate with a thickness of 0.35 mm and a width of 286 mm, which was rolled up on a roll and applied as the heat treatment with a stress relief annealing in vacuum at 550° C. for 2 hours. Further, this thin plate was made into a thin plate of 0.245 mm in thickness and 408 mm in width by cold rolling at a reduction ratio of 30%, followed similarly by application of the heat treatment of the stress relief annealing. Such operations of cold rolling and heat treatment were repeated three times until there was obtained an original shadow mask plate of 0.1 mm in thickness and 1000 mm in width.

The state of the surface after hot rolling in the above step was examined by X-ray diffraction. As a result, the f-parameter of the {100} texture was found to be 0.40, and stable {100} texture was maintained even after subsequent cold rolling and heat treatment operations.

Next, comparison was made between the cases in which etching treatments for provision of electron beam-passing perforations were applied on the original shadow mask plate having the {100} texture as prepared above and a shadow mask as a control which had been prepared by the same hot rolling as described above, followed by cold rolling at a reduction ratio of 80%/pass and stress relief heat treatment. The f-parameter of the {110} texture on the rolled face of the control shadow mask plate was 0.37. Etching was applied at a temperature of 65° C. by use of an aqueous solution containing 43% of ferric chloride, 6% of ferrous chloride and 0.1% of hydrochloric acid, to provide the electron beam-passing perforations on each plate.

Figure 1:
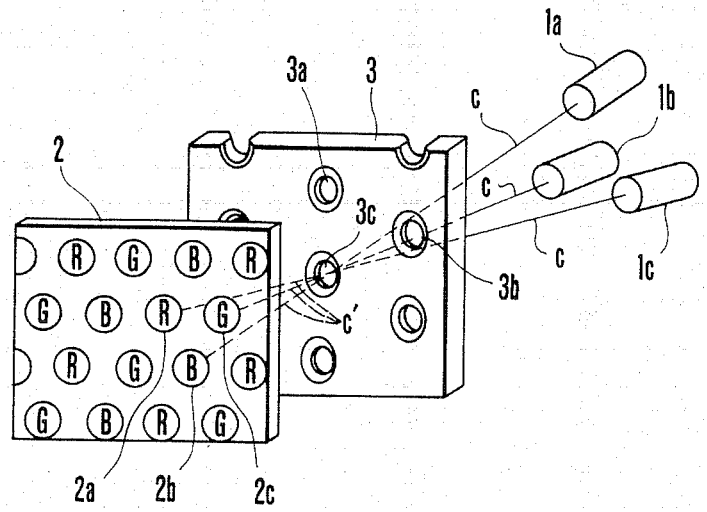
FIG. 1 is a perspective view showing a schematic constitution of a shadow mask tube using a delta type electron gun.
Figure 2:
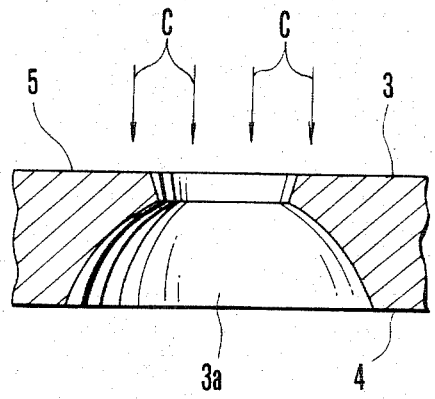
FIG. 2 is an enlarged sectional view of the electron beam-passing perforations of a shadow mask shown in FIG. 1.

In the same manner as in Example 1, the electron beam-passing perforations were made to have the shape as shown in FIG. 2 by applying successively photoetching on both sides of the shadow mask original plate. The pitches between electron beam-passing perforations were made about 0.3 mm to form about 520,000 electron beam-passing perforations as a shadow mask for 14-type television. The perforations for passing electrons on the shadow mask surface were examined to have obtained substantially the same results as in the respective cases in the present invention and the comparative example reported in Example 1.

As apparently seen from the above results, in the shadow mask according to this invention, there are formed electron beam-passing perforations uniformly and at high precision.

EXAMPLE 4

Example 3 was repeated except that the reduction ratio per pass of cold rolling was changed to 20%, to produce a shadow mask wherein a f-parameter of the {100} texture was 0.42. As the result, there was obtained the same result as in Example 3.

EXAMPLE 5

The same forging and hot rolling as described in Example 3 were applied to provide a thin plate of a 0.5 mm thickness and a 200 mm width, which was then subjected to the so-called multi-step rolling in which cold rolling at a reduction ratio of about 8%/pass is repeated several times to obtain a shadow mask original plate of a 0.1 mm thickness and a 1000 mm width having a f-parameter of the {100} texture being 0.43.

Subsequently, after application of a heat treatment of stress relief annealing at 550° C. for 2 hours, the same photoetching as in Example 3 was applied on the original plate. As the result, there was obtained highly precise and uniform electron beam-passing perforations similarly as shown in FIG. 4(*b*) and FIG. 4(*c*).

In the above Examples, reference has been made particularly to a shadow mask having round-shaped perforations for passing electrons, but this invention is not limited thereto, but it is also applicable for a process for producing a shadow mask of, for example, a slit type or a stripe type.

We claim:

1. A shadow mask for a color picture tube comprising a fluorescent face, said shadow mask comprising an alloy having (i) a face-centered cubic lattice structure and (ii) a f-parameter of the (100) texture on a surface of said alloy immediately adjacent to said fluorescent face of at least 0.35.

2. The shadow mask according to claim 1, wherein said alloy is an Fe-Ni system alloy of low expansion coefficient.

3. The shadow mask according to claim 1, which is prepared by a process comprising a step (a)′ of hot rolling a shadow mask material comprising an alloy having a face-centered cubic lattice structure to produce a (100) texture on the rolled face, a step (b)′ of applying cold rolling at a reduction ratio not exceeding 50%/pass and optionally heating at a temperature not lower than the recrystallization temperature of said alloy to obtain an original plate for the shadow mask, and a step (c)′ of applying etching on the (100) plane of said original plate to form electron beam-passing perforations.

4. The shadow mask according to claim 3, wherein the cold rolling in the step (b)′ is performed at the reduction ratio of from 5 to 30%.

5. A shadow mask according to claim 1, wherein said shadow mask further comprises a plurality of perforations which are substantially uniform in size.

6. The shadow mask according to claim 1, which is prepared by a process comprising a step (a) of hot rolling a shadow mask material comprising an alloy having a face-centered cubic lattice structure to produce a (100) texture on the rolled face, a step (b) of strong working by cold rolling of the shadow mask material to produce a (110) texture on the rolled face, a step (c) of heating the strongly worked rolled material at a temperature not lower than the recrystallization temperature of said alloy to obtain a shadow mask original plate having a (100) texture on the rolled face, and a step (d) of applying etching on the (100) plane of said original plate to form electron beam-passing perforations.

7. The shadow mask according to claim 6, wherein said alloy is an Fe-Ni system alloy of low expansion coefficient.

8. The shadow mask according to claim 6, wherein the step (c) is followed by an additional step of subjecting the original plate having the {100} texture on the rolled face to cold rolling at a reduction ratio of 25% or less.

9. The shadow mask according to claim 6, wherein the strong working by cold rolling in the step (b) is performed at a reduction ratio of 70% or more.

10. A shadow mask according to claim 9, wherein said reduction ratio is between about 70% and about 99.9%.

* * * * *

UNITED STATES PATENT AND TRADEMARK OFFICE

CERTIFICATE OF CORRECTION

PATENT NO. : 4,528,246

DATED : July 9, 1985

INVENTOR(S) : Emiko Higashinakagawa, Kanemitsu Sato, Michihiko Inaba, Yasuhisa Ohtake, Masaharu Kantou & Masayuki Itoh It is certified that error appears in the above-identified patent and that said Letters Patent is hereby corrected as shown below:

Column 3, line 45, change "Vo cos" to read --$V_o$ $\cos^2$--.

Column 5, line 15, change "diameter" to read --radius--.

Column 6, line 38, change "diameter" to read --radius--.

Column 8, line 15, change "lower" to read --higher--.

Signed and Sealed this

Twenty-seventh Day of January, 1987

*Attest:*

DONALD J. QUIGG

*Attesting Officer* *Commissioner of Patents and Trademarks*

UNITED STATES PATENT AND TRADEMARK OFFICE

CERTIFICATE OF CORRECTION

PATENT NO. : 4,528,246

DATED : July 9, 1985

INVENTOR(S) : Emiko HIGASHINAKAGAWA et al.

It is certified that error appears in the above—identified patent and that said Letters Patent is hereby corrected as shown below:

Column 3, line 45, change "Vo" to read --$V_\phi$-- .

Column 3, line 48, change "Vϕ" to read --$V_\phi$--.

Signed and Sealed this

Fifteenth Day of September, 1987

*Attest:*

DONALD J. QUIGG

*Attesting Officer*

*Commissioner of Patents and Trademarks*